US010002733B2

(12) United States Patent
Hermosillo et al.

(10) Patent No.: US 10,002,733 B2
(45) Date of Patent: Jun. 19, 2018

(54) INTERNAL TULIP SLEEVE OF THE FEMALE ARCING CONTACT OF A HIGH VOLTAGE ELECTRIC CIRCUIT BREAKER

(71) Applicant: General Electric Technology GmbH, Baden (CH)

(72) Inventors: Victor Hermosillo, Bethel Park, PA (US); Thomas Tometich, Export, PA (US); Ramaprasad E. Lakshminarayana, Belle Vernon, PA (US); Cyril Gregoire, Lozanne (FR); Alaa Alameddine, Lyons (FR)

(73) Assignee: General Electric Technology GmbH, Baden (CH)

( * ) Notice: Subject to any disclaimer, the term of this patent is extended or adjusted under 35 U.S.C. 154(b) by 0 days. days.

(21) Appl. No.: 15/058,857

(22) Filed: Mar. 2, 2016

(65) Prior Publication Data

US 2017/0256373 A1 Sep. 7, 2017

(51) Int. Cl.
*H01H 33/02* (2006.01)

(52) U.S. Cl.
CPC ..... *H01H 33/021* (2013.01)

(58) Field of Classification Search
CPC ..... H01H 33/021; H01H 33/7069; H01H 33/7076; H01H 33/664; H01H 1/025; H01H 1/0203; H01H 11/04; H01H 33/06; H01H 33/74; H01H 33/04
USPC ..... 218/21, 48, 51, 65
See application file for complete search history.

(56) References Cited

U.S. PATENT DOCUMENTS

| | | | | |
|---|---|---|---|---|
| 4,072,392 | A * | 2/1978 | McConnell | H01R 13/33 439/851 |
| 5,981,893 | A * | 11/1999 | Bleiker | H01H 1/38 218/48 |
| 6,211,478 | B1 * | 4/2001 | Schoenemann | H01H 1/021 218/16 |
| 6,259,050 | B1 * | 7/2001 | Zehnder | H01H 33/12 218/118 |
| 7,595,461 | B2 * | 9/2009 | Saxl | H01H 33/7015 218/59 |
| 7,679,021 | B2 * | 3/2010 | Gericke | H01H 11/041 218/48 |
| 2012/0129374 | A1 * | 5/2012 | Tu | H01H 1/385 439/312 |

* cited by examiner

*Primary Examiner* — Renee S Luebke
*Assistant Examiner* — William Bolton
(74) *Attorney, Agent, or Firm* — Pearne & Gordon LLP

(57) ABSTRACT

An internal tulip sleeve for the female arcing contact of a high voltage circuit breaker. According to the invention, this sleeve comprises a body of non-magnetic steel or of copper-tungsten alloy, this body comprising an internal face covered with copper.

9 Claims, 2 Drawing Sheets

INTERNAL TULIP SLEEVE OF THE FEMALE ARCING CONTACT OF A HIGH VOLTAGE ELECTRIC CIRCUIT BREAKER

TECHNICAL FIELD

The invention relates to an internal sleeve of a female arcing contact of an alternating current high voltage electric circuit breaker. Such a circuit breaker is often insulated with dielectric gas such as SF6 and arranged to blow this gas on an electric arc ignited between its contacts to extinguish this arc.

STATE OF PRIOR ART

This internal sleeve also called tulip sleeve, is made of copper for circuit breakers which have to open under currents having an intensity which is less than 63000 Amperes. This internal tulip sleeve is contrarily made of non-magnetic steel or tungsten copper alloy for circuit breakers which must open under currents having a magnitude which can be greater than 63000 Amperes.

When the circuit breaker is electrically closed, most of the current flows through main contacts of this breaker which are closed, and a portion of this current flows through its arcing contacts which are closed as well.

The arcing contacts comprise a male arcing contact having the shape of a pin or finger which is inserted into the female arcing contact, to allow the current to flow between the female and the male contacts.

When the breaker is being opened the main contacts separate first, resulting in all the current flowing through the arcing male and female contacts. As the arcing male and female contacts are separated, an electric arc ignites between these contacts. This electric arc is normally extinguished as the distance between the contacts increases during opening and as dielectric gas is blown through this electric arc.

This gas blown is due to compression and thermal expansion of the gas contained in one or two volumes connected to the arcing region.

However, this arc generates an important amount of heat which has to be evacuated quickly in both longitudinal directions in what is called a partial dual-flow arrangement. Heat and mass transfer is critical in establishing appropriate conditions of temperature and density in the arcing region in order to achieve a successful interruption of the alternating current during a zero crossing.

During this opening phase of the breaker, heat generated by the electric arc warms up the gas in the thermal volume and the arcing region. Due to this rise of temperature and to the corresponding expansion of the gas volume, the gas spontaneously expels in the direction of the female contact. This occurs as the male contact moves away from a channel extending from the volume across the arcing contacts to another volume called compression/thermal volume. During this initial stage, most of the gas flows through the internal sleeve and through an exhaust tube which extends the internal sleeve.

As the male contact passes the nozzle throat and enters the nozzle divergence, hot gas exhaust is established also in the direction of the male contact.

The material used for manufacturing the internal sleeve of the female contact is selected based on its resistance to high temperature to avoid its melting and its resistance to erosion when it is exposed to high temperature in the vicinity of the electric arc.

When the intensity of current for which the breaker is designed is less than 63000 Amperes, the internal sleeve is made of copper. The high temperature of the electric arc then provokes erosion by sublimation of a part of the copper of the internal sleeve, which vaporizes, without damaging completely this sleeve.

This limited erosion of the tulip sleeve material increases the heat transfer away from the electric arc region, with no risk of destroying the internal sleeve. This erosion by sublimation diminishes the temperature peak in the vicinity of the electric arc increasing the temperature gradient between the arcing volume and the gas in the inner volume of the sleeve.

When the breaker is designed for intensity of electric current is equal or greater than 63000 Amperes, the internal sleeve is manufactured with non-magnetic steel or with a tungsten copper alloy, since an internal sleeve made of copper would be entirely damaged by the electric arc.

But the erosion of an internal sleeve made of non-magnetic steel or copper-tungsten alloy, is almost null, which results into a reduction of the thermal transfer away from the arcing region. Therefore, the beneficial effects of sublimation of the sleeve material are not available in the materials currently used for higher short-circuit interrupting currents.

The goal of the invention is to find a suitable arrangement allowing for improvement of the heat transfer away from the arcing region for high short-circuit interrupting currents.

PRESENTATION OF THE INVENTION

The invention relates to an internal tulip sleeve for the female arcing contact of an alternating current high voltage circuit breaker, this sleeve comprising a body of non-magnetic steel or of tungsten copper alloy, this body comprising an inner face covered with copper.

With this arrangement, an electrical arc can erode the part of copper of the sleeve to improve heat transfer out of the region of the arc, with no risk of damaging the sleeve by virtue of its body made of non-magnetic steel or tungsten copper alloy which cannot be eroded by the electric arc.

The invention also relates to an internal sleeve such as defined above, wherein the body comprises an outer face which is also covered with copper.

The invention also relates to an internal sleeve such as defined above, wherein the inner face of the body is covered by a layer of copper obtained by chemical deposit of vaporized copper or by electro deposition, or fabricated separately and assembled.

The invention also relates to an internal sleeve such as defined above, wherein the outer face of the body is covered by a layer of copper obtained by chemical deposit of vaporized copper or by electro-deposition, or fabricated separately and assembled.

The invention also relates to an internal sleeve such as defined above, wherein the body and the covering of the inner face of the body are two distinct parts, the covering of copper of the inner face being mounted inside the body.

The invention also relates to an internal sleeve such as defined above, wherein the body and the covering of the outer face of this body are formed by two distinct parts, the covering of copper of the outer face being mounted around the main body.

The invention also relates to a high voltage circuit breaker comprising a female arcing contact comprising an internal sleeve such as defined above.

The invention also relates to such a circuit breaker, isolated with dielectric gas and arrange to blow gas to an electrical arc ignited upon opening, this circuit breaker comprising a collector to condense copper vaporized from the inner face of the internal sleeve upon opening of the circuit breaker, this collector being located downstream of the internal sleeve with respect to the flow of dielectric gas blown upon opening of the breaker, in order to condense the copper vaporized by this electrical arc.

The invention also relates to such a circuit breaker, wherein the collector comprises a support of thermally insulating material which carries on one of its faces a metallic wall to condense vaporized copper.

DETAILED PRESENTATION OF PARTICULAR EMBODIMENTS

Figure 1:
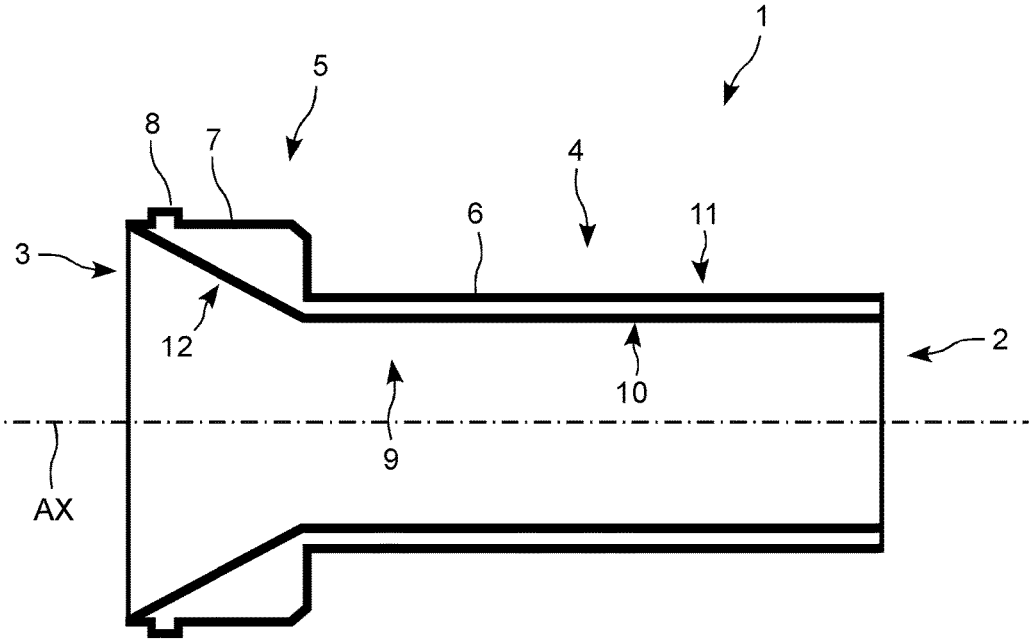
FIG. 1 is a longitudinal section of an internal sleeve of a female arcing contact of a high voltage circuit breaker according to the invention.

The internal sleeve of a female arcing contact of a circuit breaker according to the invention, marked 1 in FIG. 1, has a general rotationally symmetrical shape with respect to a longitudinal axis AX. It comprises a first extremity 2 for electric contact with a male contact, and a second extremity for mechanic and electric connection, marked 3.

This internal sleeve 1 comprises a central portion 4 which is tubular and which has one extremity at right angle that corresponds to the contact extremity 2 of the sleeve. It has an opposed extremity extended by a flare 6 which corresponds to the connection extremity 3. The main body of the central portion 4 and of the flare extremity 5 is a single part 6 which is the main body of the internal sleeve 1.

Flare 5 is externally delimited by a cylindrical surface 7 having a diameter which is greater than the external diameter of the central tubular portion 4. It comprises a circular rib 8 at its external surface.

The inner surface of this sleeve, marked 9, comprises a cylindrical part 10 corresponding to the inner face of the central tubular portion 4 and which is extended by a conic part 12 corresponding to the inner face of the flare region 5.

This conic part 12 of the inner surface expands from the cylindrical part 10 from which it extends, to connect to an extremity edge of the cylindrical surface 7 which corresponds to the connection extremity 3.

Figure 2:
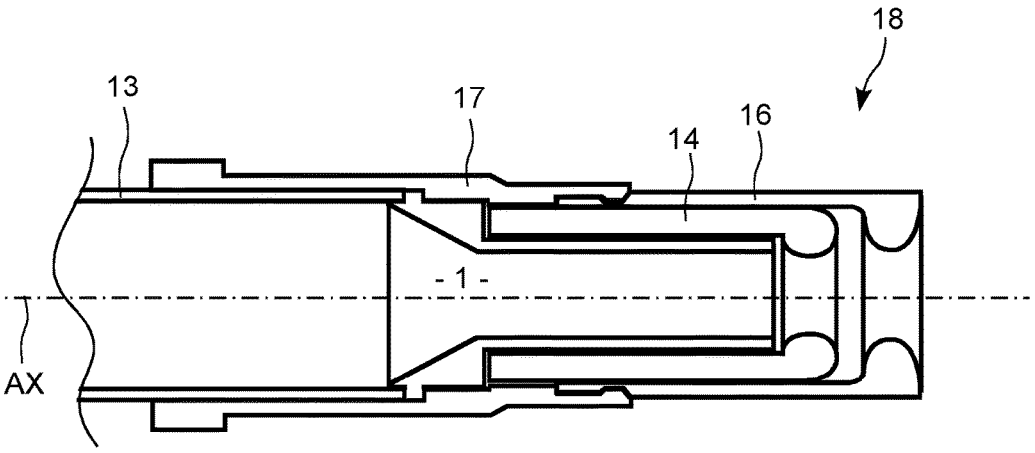
FIG. 2 is a longitudinal section of a female arcing contact of a circuit breaker having an internal sleeve according to the invention.

This internal sleeve 1 is intended to be mounted in the female contact of a circuit breaker as seen on FIG. 2, this internal sleeve 1 being mounted at the extremity of an exhaust tube 13 to extend it. According to this arrangement, a part of the flare 5 is inserted in the extremity of the exhaust tube 13. The inner diameter of the exhaust tube 13 corresponds to the outer diameter of cylindrical surface 7, and the circular rib 8 is applied against the terminal edge of the exhaust tube 13.

The exhaust tube 13 and the internal sleeve 1 which extends this tube are both oriented coaxially, along axis AX which corresponds to the longitudinal axis of the circuit breaker wherein these elements are mounted.

This internal sleeve 1 is surrounded by a first tubular element 14 which is surrounded by a second tubular element 16. These elements are secured to each other by an external sleeve 17 which overlaps the extremity of the exhaust tube 13 and a portion of internal sleeve 1 with its surrounding elements 14 and 16. This external sleeve 17 grips these components.

The female arcing contact 18 is intended to receive a male contact with an extremity having the shape of a finger, and which is inserted in the internal sleeve 1 to allow that the electric current can flow.

Figure 3:
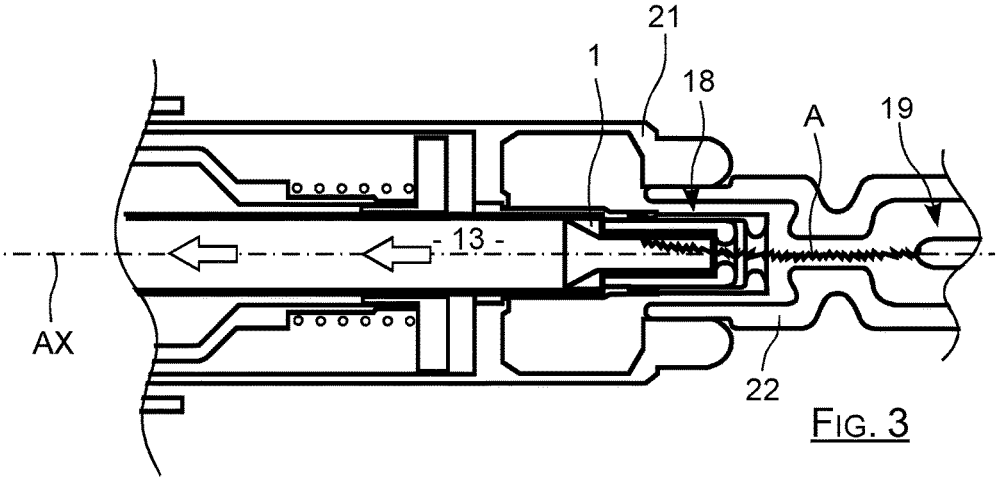
FIG. 3 is a longitudinal section of a part of a high voltage circuit breaker comprising a support carrying a female arcing contact which comprises an internal sleeve according to the invention when an electric arc is ignited.

The male contact, marked 19 on FIG. 3 and the female contact 18 are movable in translation relative to each other along the longitudinal axis AX, to be spaced one from the other upon opening of the circuit breaker, as seen in FIG. 3.

As it is the case in FIG. 3, the female contact 18 with the exhaust tube 13 that it extends, are surrounded and carried by a support 21. All these components are mounted into an insulating envelope, which is not visible in the figures, and which is filled with dielectric gas such as SF6, the circuit breaker being here arrange to blow this gas to the electrical arc ignited between its arcing contacts, in order to extinguish this electrical arc.

The extremity of support 21 comprises a main opening which surrounds the female contact 18, and which carries an insulating sleeve 22 which extends this support 21 to surround the male contact 19 even when it is spaced apart from the female contact.

When the circuit breaker is being opened, i.e. when the male contact is spaced from the female contact, an electric arc is ignited between the male contact and the interior face of the internal sleeve 1. This electrical arc, marked A in FIG. 3 comprises one root on the male contact 19 and another root on the inner surface 10 of the internal sleeve 1.

According to the invention the internal sleeve 1 comprises a body 6 which is made of a non-magnetic steel or a tungsten copper alloy, but its inner face, and possibly the outer face of this body, is covered with copper.

The layer of copper 10 can be formed at the surface of the body by chemical deposit of vaporized copper, or by electro-deposition. This layer can also be made of an additional part of copper mounted inside the body 6 of the internal sleeve.

Another layer of copper 11 can as well be present at the outer face of this body, resulting from chemical deposit of vaporized copper, electro-deposition, or made of an additional part mounted outside the body 6.

Upon opening of the circuit breaker, as in FIG. 3, the electrical arc A provokes an erosion of the inner face 9 which is made of copper. This erosion allows transferring instantly a part of the heat generated by the arc, in order to diminish the temperature around this arc.

The internal sleeve according to the invention can then be partially eroded by the electrical arc to transfer a part of its heat, but it cannot be destroyed by this arc by virtue of its main body made of non-magnetic steel or tungsten copper alloy.

In other words, the invention combines the advantages of an internal sleeve of copper which can be eroded by the arc to instantly transfer heat, with the advantages of a sleeve of non-magnetic steel or tungsten copper alloy which cannot be damaged by the electric arc.

The amount of copper on the inner face and possibly at the outer face of the main body is advantageously chosen to optimize the thermal transfer.

In addition, the circuit breaker according to the invention comprises an element to condense the vaporized copper which is sublimed during opening, in order to reduce dispersion of this vaporized copper in the dielectric gas of the installation.

Figure 4:
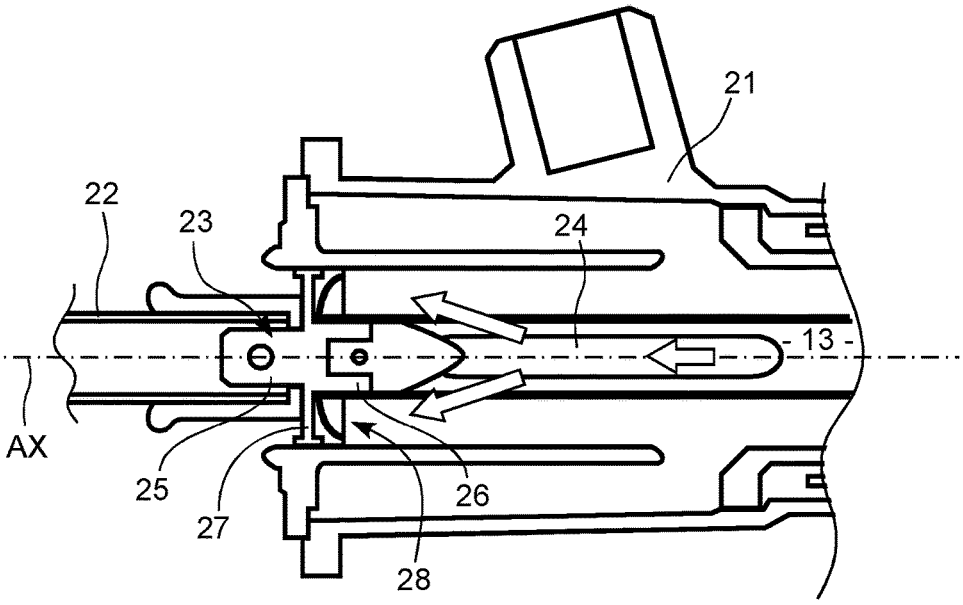
FIG. 4 is a longitudinal section of a part of a high voltage circuit breaker comprising a support of the female arcing contact in the region comprising an exhaust tube connected to the female arcing contact.

As seen in the figures, the internal sleeve 1 is mounted at the extremity of the exhaust tube 13, along which the dielectric gas is evacuated upon opening of the breaker, the circulation of the gas being shown by corresponding arrows on FIGS. 3 and 4.

This exhaust tube 13 has its extremity opposed to the one carrying the internal sleeve 1 which is electrically connected to another conductive tubular element 22 of the breaker, by means of a connection spacer 23 mounted between the extremities of tubes 13 and 22 and which closes these extremities.

When the breaker is being opened, the warm dielectric gas heated by the electrical arc A flows longitudinally in the exhaust tube 13, by passing first through the internal sleeve and then through the exhaust tube 13 in order to reach its extremity which is connected to the spacer 23.

This exhaust tube 13 comprises near its extremity of connection to the spacer 23 longitudinal slots 24, through which the warm dielectric gas is evacuated radially to the internal space of the support 21 which surrounds the tube.

As illustrated by the arrows, the warm gas uses a path which forms a small angle with longitudinal direction AX, to flow out of the exhaust tube 13, in the direction of the surrounding of the extremity of this tube.

As seen in FIG. 4, the connecting spacer comprises a first extremity 25 inserted into the free end of the exhaust tube 13, and another extremity 26 inserted in the extremity of the conductive tube 22. This spacer 23 which has a rotationally symmetrical shape also comprises a circular plate 27, having a diameter which is greater than the diameters of the tubes 13 and 22, and which extends perpendicular to direction AX.

Figure 5:
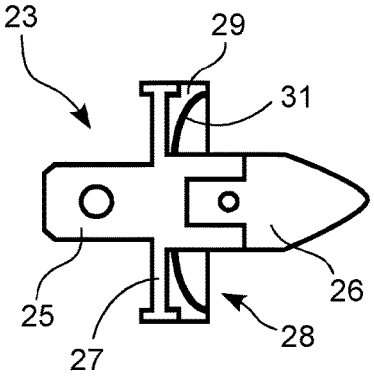
FIG. 5 is a longitudinal section of a connection spacer which comprises a collector which is included in the circuit breaker according to the invention in order to collect copper vaporized by the arc.

As seen in FIG. 5, the plate 27 carries on its face oriented towards the internal sleeve 1 a collector 28 to which is directed the flow of gas which comes out of the slots 24 of the exhaust tube 13. This gas which is a warm mix of SF6, of vaporized copper and of decomposition products, is directed against the collector 28, to allow condensation of the vaporized copper on this collector 28.

This collector 28 comprises a support 29 of thermally insulating material such as PTFE (polytetrafluoroethylene) carried by the face of plate 27 which is oriented towards the internal sleeve 1, and a metallic wall 31, here made of steel, which is carried by the free face of this support 29.

When the conductive wall receives the flow of gas, the vaporized copper condenses onto the conductive wall, ensuring that this vaporized copper does not flow to the other parts of the installation.

The invention claimed is:

1. A high voltage circuit breaker comprising:

a female arcing contact comprising an internal tulip sleeve, the sleeve comprising a body of non-magnetic steel or of tungsten copper alloy, the body comprising an inner face covered with copper, and a collector to condense copper vaporized from the inner face of the internal sleeve by an electrical arc occurring upon opening of the circuit breaker.

2. The high voltage circuit breaker according to claim 1, wherein the body of the sleeve comprises an outer face which is also covered with copper.

3. The high voltage circuit breaker according to claim 2, wherein the outer face of the body is covered by a layer of copper obtained by chemical deposit of vaporized copper or by electro-deposition, or fabricated separately and assembled.

4. The high voltage circuit breaker according to claim 2, wherein the body and the copper covering the outer face of this body are formed by two distinct parts, the copper covering the outer face being mounted around the main body.

5. The high voltage circuit breaker according to claim 1, wherein the inner face of the body is covered by a layer of copper obtained by chemical deposit of vaporized copper or by electro deposition, or fabricated separately and assembled.

6. The high voltage circuit breaker according to claim 1, wherein the body and the copper covering the inner face of the body are two distinct parts, the copper covering the inner face being mounted inside the body.

7. The high voltage circuit breaker according to claim 1, being isolated with dielectric gas and arranged to blow gas to the electrical arc ignited upon opening, the collector being located downstream of the internal sleeve with respect to a flow of dielectric gas blown upon opening of the breaker.

8. The high voltage circuit breaker according to claim 7, wherein the collector comprises a support of thermally insulating material which carries on one of its faces a metallic wall to condense vaporized copper.

9. The high voltage circuit breaker according to claim 1, wherein the collector comprises a support of thermally insulating material which carries on one of its faces a metallic wall to condense vaporized copper.

* * * * *